United States Patent [19]

Smith

[11] 4,159,940

[45] Jul. 3, 1979

[54] DENITROGENATION OF SYNCRUDE

[75] Inventor: Robert H. Smith, Plano, Tex.

[73] Assignee: Atlantic Richfield Company, Los Angeles, Calif.

[21] Appl. No.: 883,765

[22] Filed: Mar. 6, 1978

Related U.S. Application Data

[63] Continuation-in-part of Ser. No. 803,834, Jun. 6, 1977, abandoned.

[51] Int. Cl.[2] ..... C10G 23/00; C10G 17/06

[52] U.S. Cl. ..... 208/254 H; 208/254 R

[58] Field of Search ..... 208/254 H, 254 R, 90

[56] References Cited

U.S. PATENT DOCUMENTS

| | | | |
|---|---|---|---|
| 2,704,758 | 3/1955 | Wetzel | 208/254 H |
| 2,847,362 | 8/1958 | Kemp | 208/254 R |
| 2,944,063 | 7/1960 | Paulsen | 208/254 R |
| 2,984,617 | 5/1961 | De Chellis et al. | 208/90 |
| 3,719,587 | 3/1973 | Karchmer et al. | 208/254 R |
| 3,778,365 | 12/1973 | Hamner et al. | 208/254 H |

*Primary Examiner*—George Crasanakis

*Attorney, Agent, or Firm*—Roderick W. MacDonald

[57] ABSTRACT

A method for removing nitrogen from an essentially liquid syncrude feed obtained from at least one of oil shale, tar sands, and coal wherein the syncrude is mixed with an acid selected from the group consisting of sulfuric, phosphoric, hydrochloric, and combinations thereof, settling to form a first phase composed of syncrude low in nitrogen and a second phase composed of acid and syncrude high in nitrogen, separating the two phases, and catalytically hydrotreating the high nitrogen phase to reduce its nitrogen content.

5 Claims, 2 Drawing Figures

DENITROGENATION OF SYNCRUDE

CROSS REFERENCES TO RELATED APPLICATIONS

This is a continuation-in-part of U.S. application Ser. No. 803,834 filed June 6, 1977 and now abandoned.

BACKGROUND OF THE INVENTION

Hydrocarbonaceous liquids (full range or cuts thereof) obtained from oil shale, tar sands, and normally solid coal, i.e., syncrude, generally contain relatively high quantities of nitrogen in various forms, generally five and six member cyclic compounds such as pyridines and indoles. It is desirable in a number of cases to reduce the nitrogen quantity of such syncrude materials, particularly if they are to be used as fuel. However, where there is a high nitrogen content, severe hydrogenation conditions, e.g., high pressure, low space velocity, and the like, are necessary. Such conditions elevate the cost of processing because larger and more expensive hydrogenation reactors are required together with greater hydrogen consumption in the operation.

Thus, it is highly desirable to reduce the nitrogen content of the syncrude feed prior to hydrogenation thereof.

Heretofore the prior art, U.S. Pat. No. 2,704,758 to Wetzel, has employed with nitrogen containing hydrocarbonaceous feeds an extraction step using formic acid, a highly volatile organic acid, followed by a decomposition distillation step for separating the highly volatile organic acid and associated oil from a high nitrogen phase (nitrogen base concentrate). The high nitrogen phase was then subjected to pyrolytic hydrogenolysis which is clearly taught to be non-catalytic and therefore is nothing more than pyrolytic decomposition in the presence of hydrogen. The prior art's extraction with a highly volatile organic acid, distillation for separation, and pyrolytic hydrogenolysis are severe requirements from a commercial point of view.

This invention eliminates such requirements without sacrificing nitrogen removal and with minimum hydrogen comsumption.

SUMMARY OF THE INVENTION

According to this invention a syncrude feed containing nitrogen is mixed with at least one acid selected from the group consisting of sulfuric, phosphoric and hydrochloric and a first phase composed of syncrude low in nitrogen and a second phase composed of acid and syncrude high in nitrogen formed by settling. Thereafter the two phases are separated and only the phase high in nitrogen is catalytically hydrotreated thereby minimizing hydrogen consumption. If desired, it is within the scope of this invention also to hydrotreat the phase which is low in nitrogen, although in the broadest sense of this invention hydrotreating of the phase low in nitrogen is not required.

Accordingly, it is an object of this invention to provide a new and improved method for processing syncrude materials. It is another object to provide a new and improved method for denitrogenation of syncrude feed. It is another object to provide a new and improved method for minimizing the hydrogenation costs in the processing of syncrude feeds.

Other aspects, objects and advantages of this invention will be apparent to those skilled in the art from this disclosure and the appended claims.

DETAILED DESCRIPTION OF THE INVENTION

Figure 1:
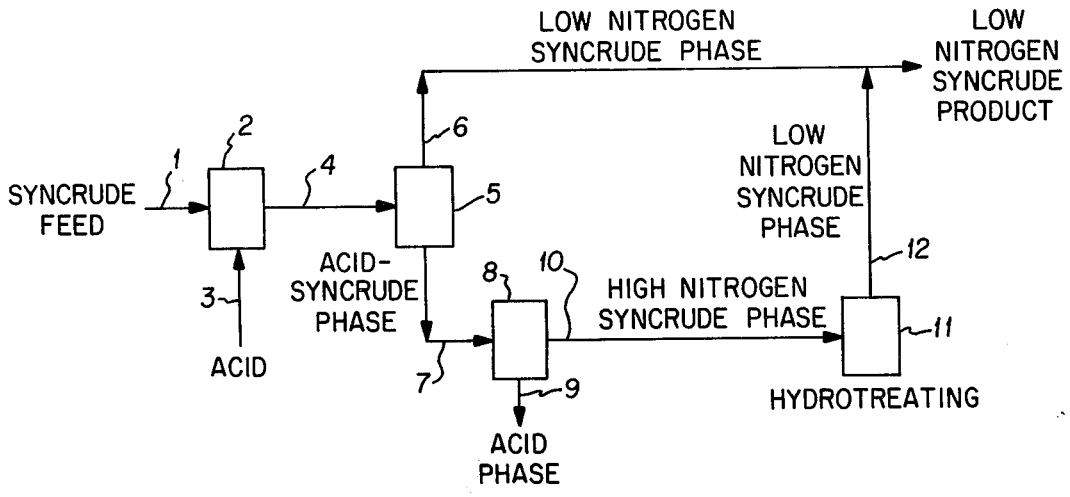
FIG. 1 shows a process embodiment within this invention wherein the syncrude feed is mixed with acid and thereafter the low nitrogen syncrude phase is separated from the high nitrogen acid containing syncrude phase, the high nitrogen phase having acid removed therefrom and thereafter being subjected to catalytic hydrotreating.

FIG. 1 shows syncrude feed in pipe 1 which feed is at least one hydrocarbonaceous liquid, full range or cuts thereof, obtained from tar sands, oil shale, and/or normally solid coal which feed contains an amount of nitrogen that is to be reduced. Depending upon the desired use of the syncrude, such a stream could contain any amount of nitrogen, e.g., 10 ppm or 10 weight percent.

The feed passes from pipe 1 into mixer 2 wherein an acid, mixture of acids, or mixture of acids and salts of acids, passes into mixer 2 by way of pipe 3 and therein mixes with the feed. The acid employed can be one or more of phosphoric, sulfuric, and hydrochloric. These mineral acids are not highly volatile like formic acid and, therefore, would not work in the prior art decomposition distillation step. Phosphoric acid is preferred because it can be regenerated for reuse in the process. The salts of the acids can be ammonium or alkali metals, preferably sodium or potassium. The acid is mixed with the feed in amounts which vary depending upon the feed and its nitrogen content, but generally in a minimum amount of at least about 5 weight percent acid based on the total weight of the feed. The maximum amount of acid employed is not critical to the operability of the process but rather depends on the economics of the process.

The acid tends to react with the nitrogen compounds present, for example to form quaternary ammonium salts and the like, thereby separating the syncrude feed into two phases. The first phase is composed of a syncrude low in nitrogen content. The second phase is an acid phase containing syncrude high in nitrogen content. The first and second phases are physically separable. The low nitrogen syncrude phase contains at least 20 percent by weight lower nitrogen concentration than the acid-high nitrogen syncrude phase.

The acid treated syncrude is passed from mixer 2 by way of pipe 4 into separator 5 wherein the two phases are allowed to physiclly separate due to density differentials. The prior art decomposition distillation step and its attendant costs and operating problems are excluded from this invention and replaced with a simple, low cost settling step. The low nitrogen syncrude phase is removed by way of pipe 6 while the acid-high nitrogen syncrude phase is separately removed by way of pipe 7.

The low nitrogen phase can be removed from the process as a low nitrogen syncrude product.

The acid-syncrude phase in pipe 7 is transferred to separator 8 wherein the acid is neutralized as discussed in greater detail hereinafter in reference to FIG. 2, removed by way of pipe 9 thereby leaving a high nitrogen syncrude phase which is removed by way of pipe 10 to catalytic hydrotreater 11. This invention excludes the prior art pyrolytic hydrogenolysis step and instead uses a more efficient catalytic hydrogenation step. In hydrotreater 11, which uses conventional catalytic hydrotreating processes well known in the art, the nitrogen content of this syncrude phase, among other things, is reduced to yield another low nitrogen syncrude phase. This phase is removed by way of pipe 12, also has at least 20 weight percent lower nitrogen concentration than the acid-high nitrogen syncrude phase and can be combined with the low nitrogen phase in pipe 6 or utilized as a separate low nitrogen syncrude product.

Any conventional catalytic hydrotreating process and catalyst can be employed in hydrotreater 11 such as that disclosed in U.S. Pat. No. 4,003,829, the disclosure of which is incorporated herein by reference.

Figure 2:
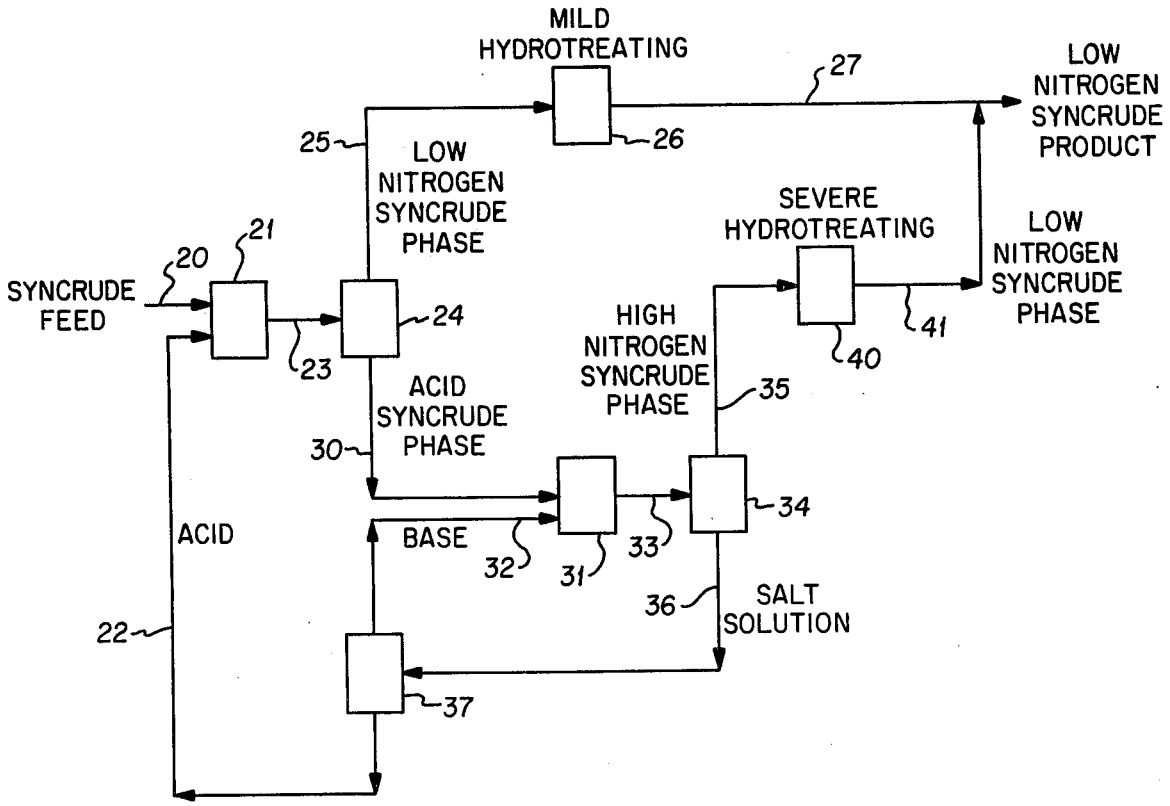
FIG. 2 shows another embodiment within this invention similar to the process of FIG. 1 except that FIG. 2 shows the low nitrogen syncrude phase being catalytically hydrotreated and also shows an acid separation process involving neutralization with a base followed by separation and distillation to separate the base from the acid.

FIG. 2 shows the syncrude feed in pipe 20 passing into mixer 21 wherein it is mixed with acid from pipe 22 and then passed by way of pipe 23 to separator 24. The low nitrogen syncrude phase is removed by way of pipe 24 and, in this particular situation, passed to a catalytic hydrotreater 26 for mild hydrotreating. This saves on hydrogen consumption because only light hydrotreating is necessary, i.e., low temperature, high space velocity, etc., since this phase is already low in nitrogen. The product syncrude phase from hydrotreater 26 is removed from the process by way of pipe 27.

The acid-syncrude phase which is high in nitrogen content relative to the fluid in pipe 25 is removed from settling separator 24 by way of pipe 30 and passed to neutralizer 31. In neutralizer 31 the acid-syncrude phase is mixed with a base, such as an ammonium or alkali metal hydroxide, from pipe 32 wherein the acid is neutralized by the formation of a salt and the neutralized mixture then passed by way of pipe 33 to settling separator 34 wherein, by gravity or other means, it is physically separated into a high nitrogen syncrude phase, which is removed by way of pipe 35, and a salt solution phase which is separately removed by way of pipe 36.

The salt solution is transferred to distillation unit 37 wherein the base and acid are regenerated, the base being removed overhead by way of pipe 32 for reuse in neutralizer 31. The regenerated acid is removed from still 37 by way of pipe 22 for reuse in mixer 21.

The high nitrogen syncrude phase in pipe 35 is then subjected to severe catalytic hydrotreating in hydrotreater 40 and the low nitrogen syncrude phase product from hydrotreater 40 is removed by way of pipe 41 for combination with the product in pipe 27 or separate utilization as desired. If desired, the high nitrogen syncrude phase can also be re-extracted from the acid-syncrude phase using a hydrocarbon solvent.

EXAMPLE

A process similar to that shown in FIG. 1 was carried out using a shale oil feed formed from Colorado oil shale which contained 2.17 weight percent nitrogen.

The syncrude feed was mixed with an aqueous phosphoric acid solution containing 42.5 weight percent phosphoric acid. Equal weights of said phosphoric acid solution and the syncrude feed were mixed. The mixing was carried out at 100° F. and atmospheric pressure for 15 minutes after which the mixture was passed to a separator and allowed to set for 30 minutes at essentially quiescent conditions and ambient conditions of temperature and pressure until, due to density variations, two phases formed. One phase was a low nitrogen syncrude phase containing 0.99 weight percent nitrogen and essentially no acid. The second phase contained essentially all of the acid and a high nitrogen syncrude phase containing 4.73 weight percent nitrogen. The low nitrogen syncrude phase was removed from the separator and from the process as a final product.

The acid-high nitrogen syncrude phase was transferred to a neutralizer wherein an aqueous solution containing 58 weight percent ammonium hydroxide was added. The ammonium hydroxide solution was added in the amount of 15.3 weight percent based on the total weight of the acid-syncrude phase feed to the neutralizer and was mixed at 100° F. and atmospheric pressure for 15 minutes to neutralize the phosphoric acid present and to form an ammonium phosphate salt. This mixture was then transferred to a separator and subjected to quiescent conditions for 30 minutes at ambient conditions of temperature and pressure wherein, due to gravity differentials, two phases formed. One phase was a high nitrogen syncrude phase which was removed for catalytic hydrotreating. The other phase was a separate salt solution phase which was removed separately.

The high nitrogen syncrude phase containing 4.73 weight percent nitrogen was then passed to a hydrotreating unit which contained a conventional nickel-molybdenum hydrotreating catalyst and was therein exposed to molecular hydrogen at 700° F. and 2,000 psig. The weight hourly space velocity was 0.5 lb. of feed oil per lb. of catalyst per hour. The low nitrogen syncrude phase produced by the hydrotreater was removed and contained 1.99 weight percent nitrogen. This material was combined with the product material from the low nitrogen syncrude product phase.

Reasonable variations and modifications are possible within the scope of this disclosure without departing from the spirit and scope of this invention.

The embodiments of the invention in which an exclusive property or privilege is claimed are defined as follows:

1. A method for reducing the nitrogen content of a syncrude feed obtained from at least one of oil shale, tar sands, and coal, comprising mixing at least one acid selected from the group consisting of sulfuric, phosphoric, and hydrochloric with said feed, settling said mixture to form a first phase composed of a syncrude low in nitrogen and a second phase composed of acid and a syncrude high in nitrogen, separating said first and second phases from each other, neutralizing said second phase with a base to form a salt with the acid in said second phase, settling said neutralized second phase to form a high nitrogen syncrude phase and a salt solution, separating said salt solution from said high nitrogen syncrude phase, and catalytically hydrotreating said high nitrogen syncrude phase to remove nitrogen and produce a product composed of syncrude low in nitrogen, said first phase and said product containing at least 20 percent by weight lower nitrogen concentration than said high nitrogen syncrude phase.

2. The method according to claim 1 wherein at least 5 weight percent acid based on the total weight of said feed is employed.

3. The method according to claim 1 wherein said first phase is separately hydrotreated to reduce its nitrogen level.

4. The method according to claim 1 wherein said acid is phosphoric acid.

5. The method according to claim 1 wherein said base is ammonia.

* * * * *